US012441497B2

(12) United States Patent
Zagnoni et al.

(10) Patent No.: US 12,441,497 B2
(45) Date of Patent: Oct. 14, 2025

(54) CARTONING MACHINE

(71) Applicant: PLUSLINE S.R.L., Zola Predosa (IT)

(72) Inventors: Christian Zagnoni, Calcara Valsamoggia (IT); Leonardo Stamati, Bologna (IT)

(73) Assignee: PLUSLINE S.R.L., Zola Predosa (IT)

( * ) Notice: Subject to any disclaimer, the term of this patent is extended or adjusted under 35 U.S.C. 154(b) by 0 days.

(21) Appl. No.: 18/724,616

(22) PCT Filed: Feb. 9, 2023

(86) PCT No.: PCT/IT2023/050039
§ 371 (c)(1),
(2) Date: Jun. 27, 2024

(87) PCT Pub. No.: WO2023/157032
PCT Pub. Date: Aug. 24, 2023

(65) Prior Publication Data

US 2025/0074636 A1 Mar. 6, 2025

(30) Foreign Application Priority Data

Feb. 17, 2022 (IT) ..... 102022000002921

(51) Int. Cl.
*B65B 5/02* (2006.01)
*B65B 5/06* (2006.01)
*B65B 43/14* (2006.01)

(52) U.S. Cl.
CPC ..... *B65B 5/024* (2013.01); *B65B 5/06* (2013.01); *B65B 43/145* (2013.01)

(58) Field of Classification Search
CPC ..... B65B 5/024; B65B 5/06; B65B 43/145; B65B 65/006; B65B 65/003; B65B 65/00
See application file for complete search history.

(56) References Cited

U.S. PATENT DOCUMENTS 1,874,669 A * 8/1932 Wagner ..... B65B 5/06 53/250
3,022,615 A * 2/1962 Schroeder ..... B65B 61/02 53/496
3,039,248 A * 6/1962 Jones ..... B65B 5/06 53/381.1
3,137,981 A * 6/1964 Johnson ..... B65B 43/145 53/64

(Continued)

*Primary Examiner* — Joshua G Kotis
*Assistant Examiner* — Scott A Howell
(74) *Attorney, Agent, or Firm* — Rivka Friedman

(57) ABSTRACT

Cartoning machine comprising a magazine configured to store stacks of cardboard dies (F) and means for picking up and transporting the dies (F) to move the dies (F) along a path (FM, FS) between the magazine, an unfolding station (S) and a product insertion station (N). The magazine comprises two mobile storage units (M1, M2) for storing the stacked dies, each mobile storage unit (M1, M2) being configured to store a respective stack (P1, P2) of dies (F). Cyclically, each mobile storage unit is in a waiting position while the other unit is in an operating position in which the means for picking up and transporting the dies are arranged and active. The storage units (M1, M2) are arranged one on a right side (DT) and one on a left side (ST) of the machine with respect to said path.

6 Claims, 9 Drawing Sheets

(56) References Cited

U.S. PATENT DOCUMENTS 3,269,091 A * 8/1966 Roy ..... B65B 63/022 53/526
3,541,760 A * 11/1970 Hickin ..... B65B 5/024 53/169
3,941,037 A * 3/1976 Reichert ..... B65B 35/50 493/449
5,115,625 A * 5/1992 Barbulesco ..... B65B 7/20 53/284
5,454,211 A * 10/1995 Ziegler ..... B65B 5/024 53/448
5,727,365 A * 3/1998 Lashyro ..... B65B 61/207 53/238
6,050,062 A * 4/2000 Petersson ..... B65B 43/185 53/565
6,968,668 B1 * 11/2005 Dimario ..... B65B 5/106 53/376.4
8,621,831 B2 * 1/2014 Moylan ..... B65B 39/06 53/169
8,622,686 B2 * 1/2014 Stringfield ..... B65G 59/005 414/794.3
8,899,001 B2 * 12/2014 Bachelle ..... B65B 35/50 53/171
8,997,438 B1 * 4/2015 Fallas ..... B25J 9/0093 901/17
9,487,315 B2 * 11/2016 Poutot ..... B65B 5/024
11,298,908 B2 * 4/2022 Nakamura ..... B65B 5/024
2007/0204567 A1 * 9/2007 Wintring ..... B65B 5/024 53/452
2008/0141632 A1 * 6/2008 Monti ..... B65B 5/024 53/566
2011/0154784 A1 * 6/2011 Poutot ..... B65B 5/105 53/247
2012/0011808 A1 * 1/2012 Langen ..... B65B 43/145 53/235
2012/0096808 A1 * 4/2012 Poutot ..... B65B 5/024 53/235
2012/0208686 A1 * 8/2012 Iwasa ..... B65B 7/20 493/162
2012/0324833 A1 * 12/2012 Koch ..... B65B 21/24 53/558
2014/0083062 A1 * 3/2014 Arimatsu ..... B65B 5/06 53/564
2015/0031519 A1 * 1/2015 Cavazza ..... B65B 11/004 493/441
2016/0185475 A1 * 6/2016 Pettersson ..... B65B 43/08 53/493
2017/0101200 A1 * 4/2017 Anderson ..... B65B 59/04
2018/0162083 A1 * 6/2018 Capoia ..... B31B 50/16
2019/0263600 A1 * 8/2019 Iwasa ..... B65B 57/00
2019/0337656 A1 * 11/2019 Langen ..... G05B 19/418
2020/0254707 A1 * 8/2020 Iwasa ..... B65B 5/024
2025/0074636 A1 * 3/2025 Zagnoni ..... B65B 5/024

* cited by examiner

CARTONING MACHINE

The present invention relates to a cartoning machine.

It is known that a cartoning machine, also known as "case packer", is intended to package products inside cardboard boxes. Typically, a cartoning machine comprises: a product entry station; a magazine in which the cartons are stacked in an "extended" or flattened form; means for picking up the flat cartons from the magazine and putting them in shape or "unfolding", suitable for picking up individual flat cartons from the magazine and arranging them in an open configuration which allows introducing the products inside them; means for folding the lateral, upper and lower flaps of the cartons opened after or before the insertion of the products inside the latter; means for gluing said flaps to close the cartons; and means for transporting the closed cartons along a predefined exit path.

A machine according to the present invention is a cartoning machine generally configured as described above, which implements technical solutions aimed at increasing its production.

This result has been achieved, in accordance with the present invention, by adopting the idea of making a machine having the characteristics indicated in claim 1. Other characteristics of the present invention are the subject of the dependent claims.

Thanks to the present invention, it is possible to increase the production of the cartoning machines, i.e. the number of complete packages per minute, without however compromising the quality of the packages thus produced.

These and further advantages and features of the present invention will be more and better understood by any person skilled in the art thanks to the following description and the annexed drawings, provided by way of example but not to be considered in a limiting sense, in which.

Figure 13:
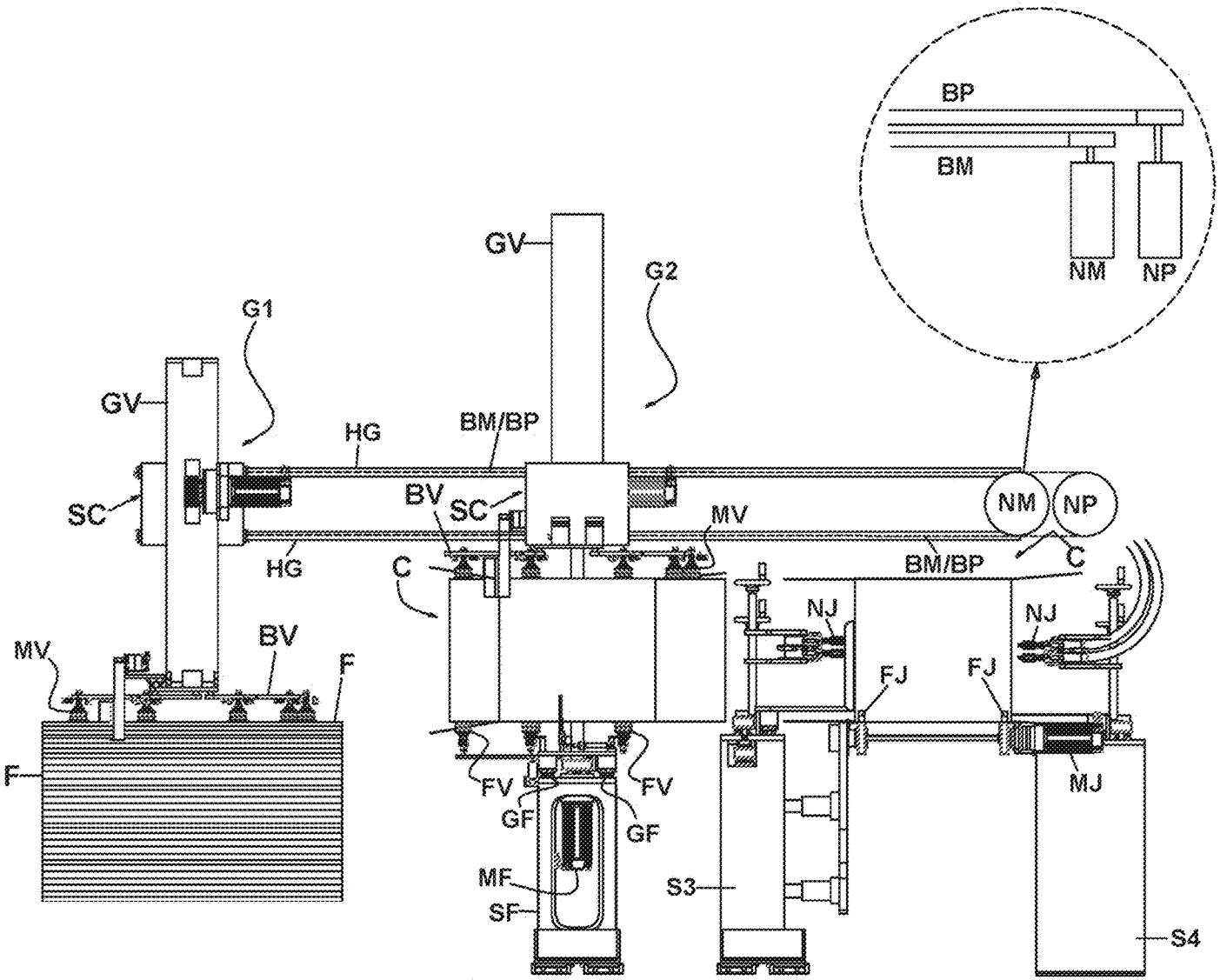
Figure 14:
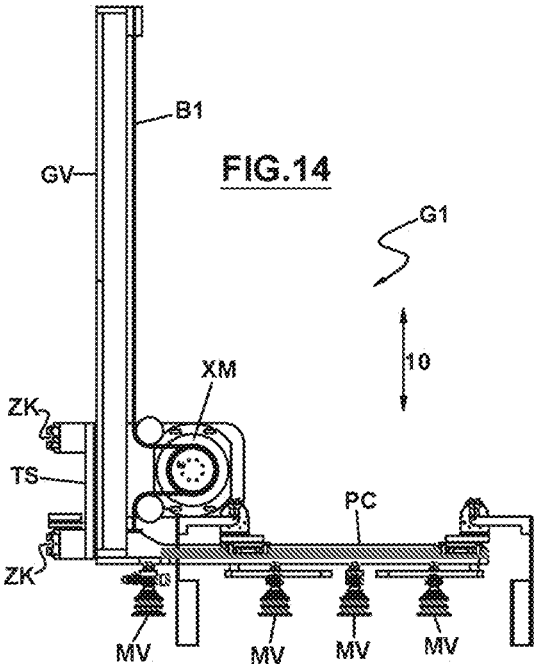
Figure 15:
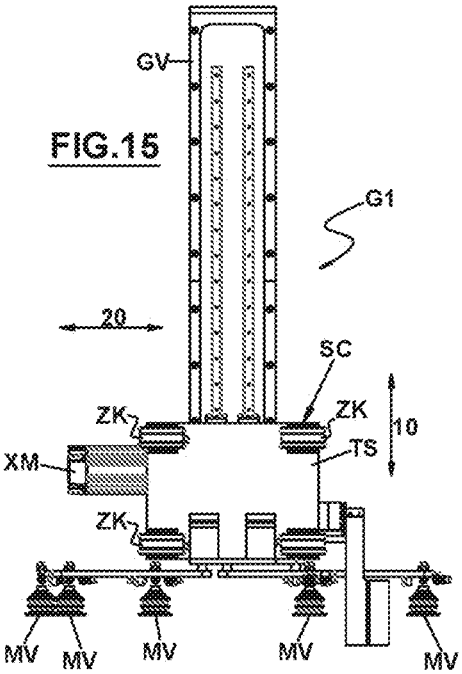
Figure 16:
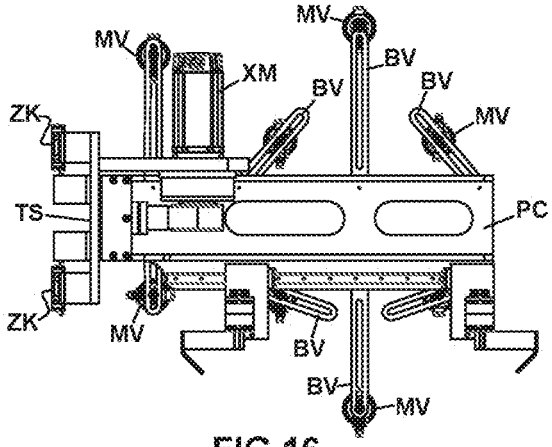
Figure 17:
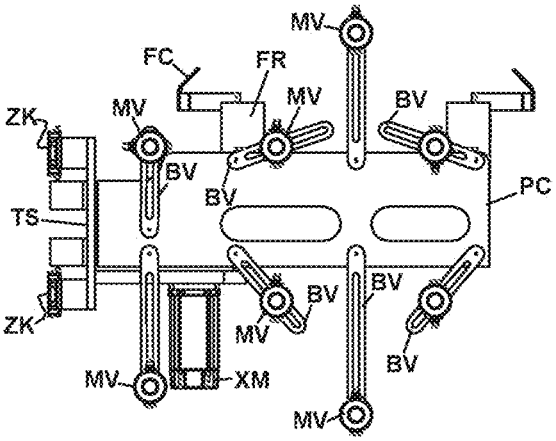
Figure 18:
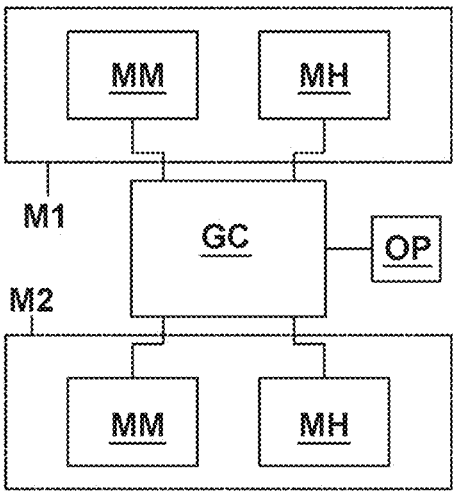

FIG. 13 schematically illustrates two assemblies for picking up and transporting the dies in operational configuration;

FIGS. 14-17 show a side view, a rear view, a top plan view and a bottom view of a dies picking and transport unit;

FIG. 18 is a simplified block diagram relating to a possible control mode of the storage units.

Reduced to its essential structure and with reference to the accompanying drawings, a cartoning machine according to the present invention comprises:

- a magazine (M) configured to store stacks of flat cartons (F), also called "dies" in jargon;
- means for picking up and transporting the dies (F);
- an unfolding station (S), in which the dies (F) are shaped, assuming the configuration of an open substantially parallelepiped box (C) defined by an upper base (CU), a lower base (CL), two lateral bases (CS), a front base (CF) and a rear base (CR), in which the front base and the rear base are open but intended to be closed by flaps made up of appendices (PU, PL) of the upper and lower bases and bottom and appendices (PS) of the lateral bases: said lateral, upper and lower bases being defined by respective portions of the dies (F);
- a product feeding station (A), where are fed the products (RC) intended to be packaged in the boxes (C) obtained from the dies (F);
- an insertion station (N), where the products (RC) are inserted into the open boxes (C);
- a station (G) for gluing the aforementioned flaps, i.e. for closing the boxes (C);
- an exit station (U) for the completed packages.

Figure 1:
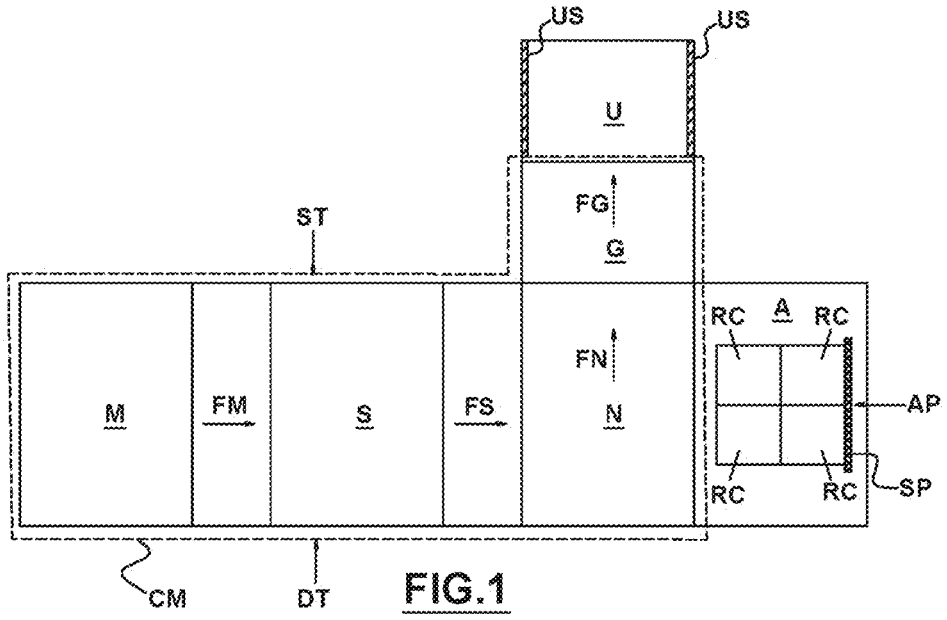
FIG. 1 represents a block diagram illustrating the operating stations of a cartoning machine according to the present invention seen in a top plan view.
Figure 2:
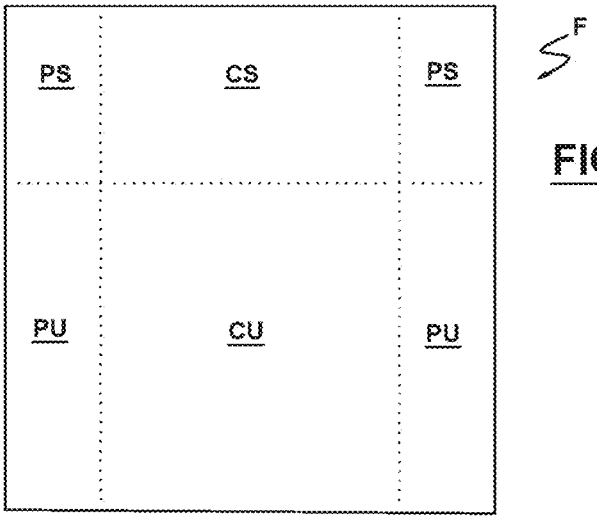
FIG. 2 represents a schematic top plan view of a cardboard die.
Figure 3:
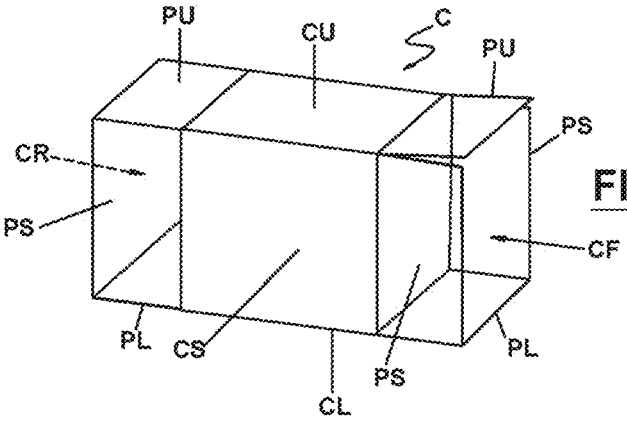
FIG. 3 represents a schematic perspective view of an open cardboard box.
Figure 4A:
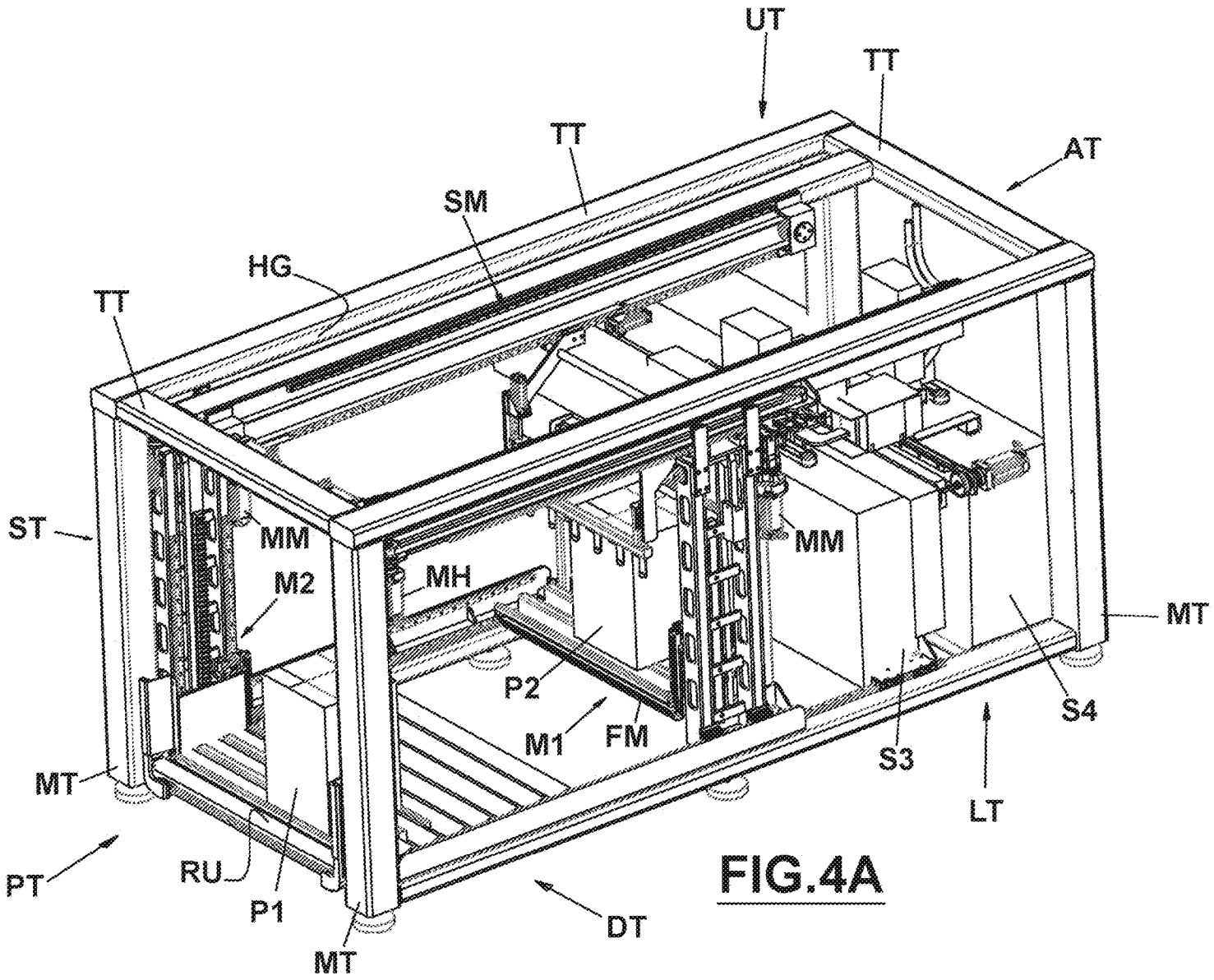
FIGS. 4A-4B represent two schematic top perspective views of a cartoning machine in accordance with the present invention in possible operating configurations, with parts removed to better highlight others.
Figure 4B:
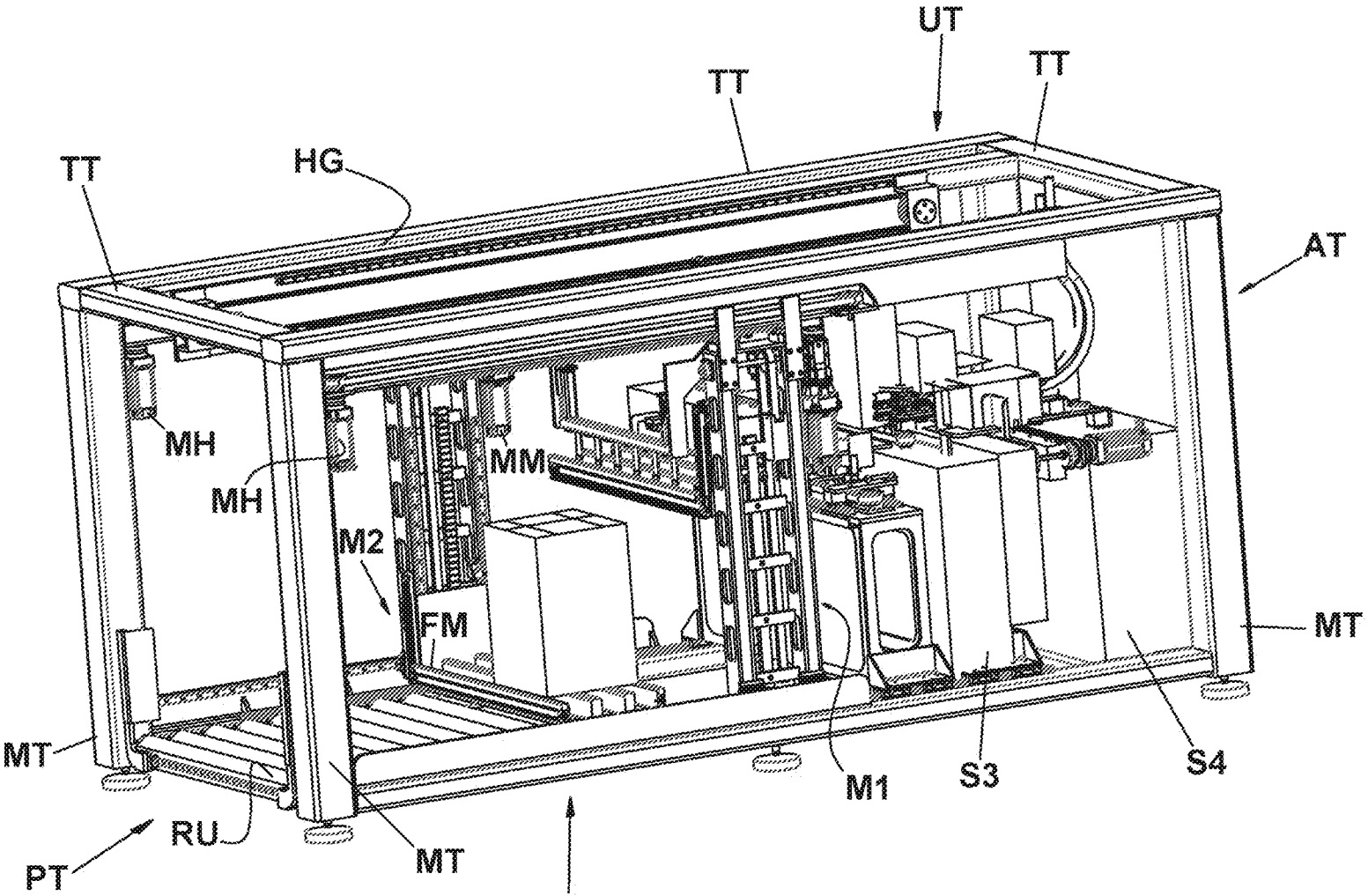

In FIG. 1 the arrow "AP" shows the direction followed by the products (RC) in the feeding station (A). For example, the products (RC) are toilet paper rolls or kitchen towel rolls packaged in plastic or paper wrappers. For example, with per se known methods, the products (RC) are transported to the feeding station (A) by means of conveyors (represented by the arrow "AP") and a pusher (SP) is provided in the feeding station (A) for pushing the products, along the direction (AP), towards the insertion station (N) to insert the products into the open boxes (C). The arrow "FM" shows the direction followed by the dies from the magazine (M) to the unfolding station (S), while the arrow "FS" shows the direction followed by the blanks from the unfolding station (S) to the insertion station (N). The arrow "FN" shows the direction followed by the opened and filled boxes from the inserting station (N) to the gluing station (G). The arrow "FG" shows the direction followed by the boxes from the gluing station (G) to the exit station (U).

The set formed by the magazine (M), the means for picking up and transporting the dies, the unfolding station (S), the insertion station (N) and the station (G) for gluing or closing the boxes, constitutes the so-called "machine body" (CM). The latter comprises a fixed structure made up of a metal frame which defines a lower side (LT), an upper side (UT), a right side (DT), a left side (ST), a front side (AT) and a back side (PT). With reference to the accompanying illustrative drawings, said metal frame is formed by a plurality of uprights (MT) and crosspieces (TT) which, in cooperation with each other, define said sides of the metal frame and, consequently, of the machine body (CM), which in FIG. 1 is highlighted by a discontinuous perimeter line. The right and left sides are defined in relation to the direction (FM) followed by the dies (F).

Inside the machine body a process takes place in which, according to an operating scheme known per se, each die (F) is taken from the magazine, by means of suitable picking and transport means, and is transported to the unfolding station (S), where it is unfolded, i.e. it is opened and shaped, obtaining an open box (C). In the unfolding station (S) there is a zone for temporary retention of a lower side of the die, defined by a plurality of lower pneumatic suction cups (FV) positioned on a corresponding support (SF). When a die (F) reaches the unfolding station (S), engaged by the means for picking up and transporting the dies, the portion of the die (F) which defines the lower base (CL) of the box (C) is pneumatically engaged by the lower suction cups (FV) which, therefore, pneumatically engage this portion of the die. Then, the means for picking up and transporting the dies are raised, while the lower suction cups (FV) are moved horizontally in a direction orthogonal to the direction (FM) previously followed by the dies (i.e. in a direction orthogonal to the plane of the sheet in reference to FIG. 13), so that the die is shaped, assuming the shape of an open box (C)

with both the front and rear bases open. For this purpose, the lower suction cups (FV) are mounted on guides (GF) oriented according to said direction orthogonal to the direction followed by the dies. The movement of the lower suction cups (FV) is controlled by a corresponding electric motor (MF) positioned in the respective support (SF). Subsequently, the box (C) is transported to the insertion station (N), where the products (RC) to be packaged are inserted into the box (C) through the front base (CF) of the latter. Subsequently, the flaps (PS) are folded, by means of folders acting both on the front side and on the back side of the boxes (C), and on them, in the gluing station (G), a predetermined amount of glue is distributed. The flaps (PU) and (PL) are then folded over the flaps (PS), causing the front and rear bases of the boxes to close. Finally, the closed boxes are transported along the exit station (U). In the exit station (U) there are counterfacing motorized belts (US) that engage the boxes on the front and rear sides of the same, moving them towards the outside of the machine.

Figure 6:
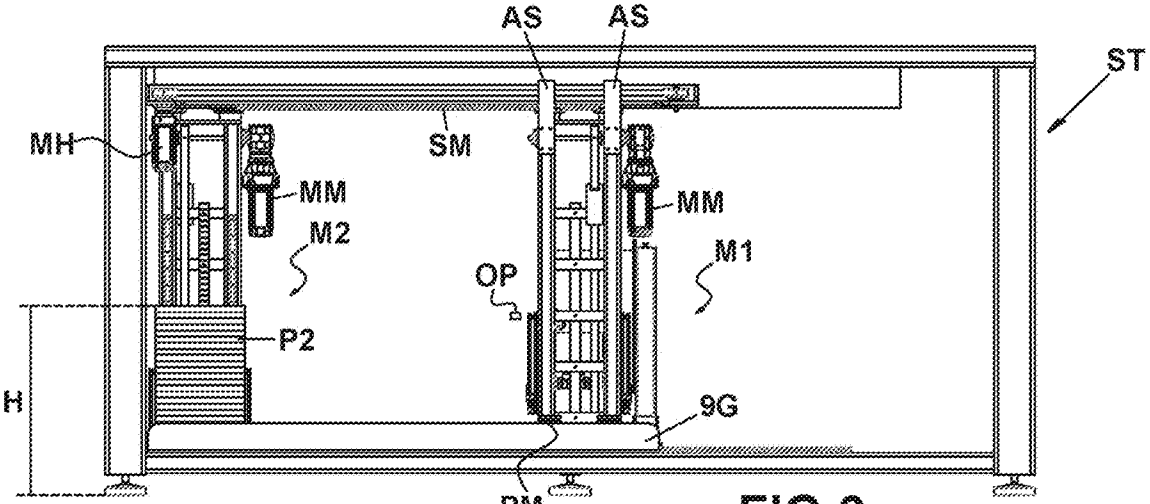
FIGS. 5-8 show different operating configurations of the storage units.
Figure 5:
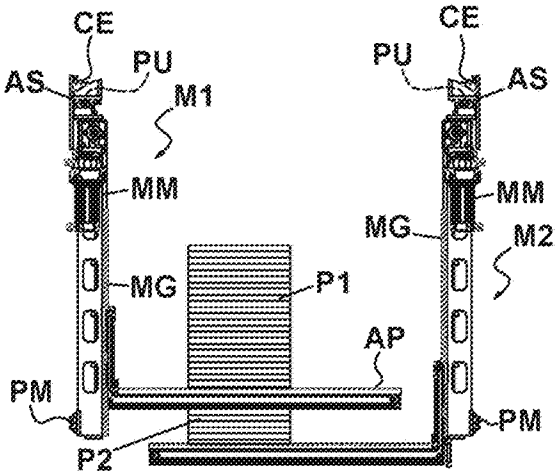
Figure 8:
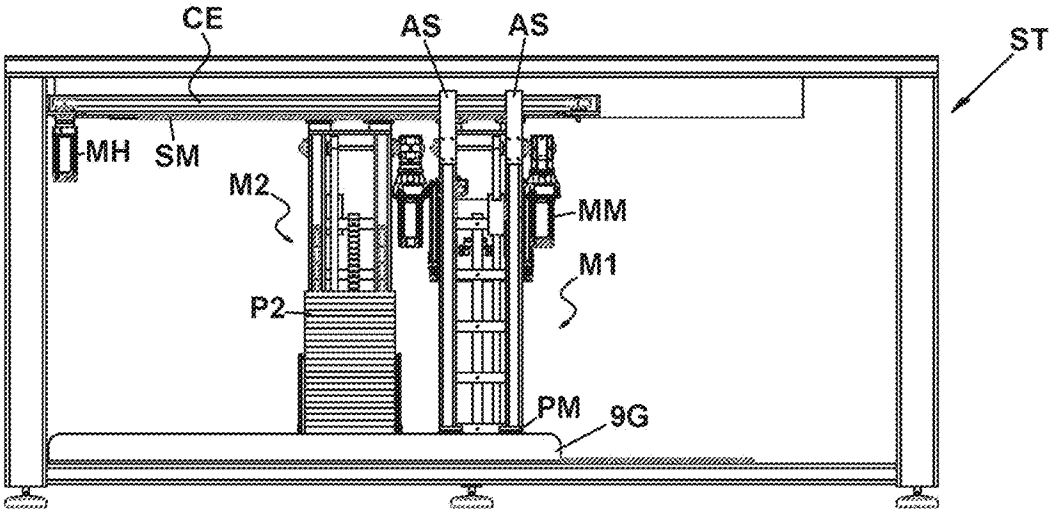
Figure 7:
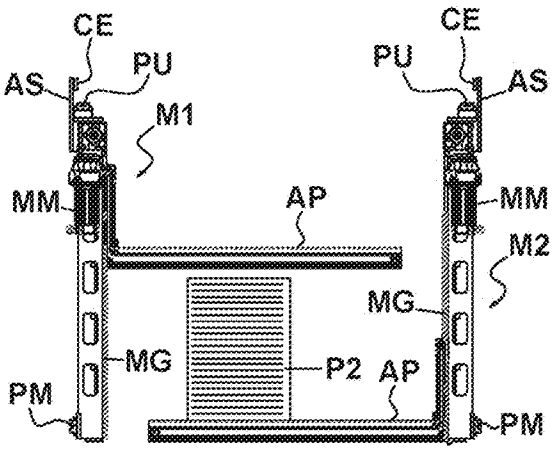

Advantageously, the magazine (M) comprises two mobile units (M1, M2) for storing the stacked dies. For example, each unit (M1, M2) comprises means suitable for lifting a respective stack (P1, P2) of dies as the dies (F) are withdrawn from the same stack, so that, preferably, the first available die, i.e. the highest die in the stack, is always at the same height (H) with respect to a horizontal reference surface, for example with respect to the base on which the machine rests. For this purpose, each unit (M1, M2) has a support surface (AP) for the respective stack (P1, P2) which is preferably raised each time a die (F) is removed. The lifting to which the support surface (AP) is subjected at each picking is equal to the thickness of the dies. Said storage units (M1, M2) are constrained to slide horizontally, one on the right side and the other on the left side of the machine body. The movement of the storage units (M1, M2) along said sides of the machine body is controlled by respective independent actuators (MH). Therefore, the support surfaces (AP) can be moved independently along the right and left sides of the machine body (CM). For example, in FIGS. 5-6 the mobile storage unit (M2) is in the waiting position on the rear side of the machine body, loaded with a new stack of dies (P2), while the mobile storage unit (M1) is in the position for picking up the dies from the respective stack (P1) by the means of transport and picking up the dies. In FIGS. 7-8 the stack of the mobile storage unit (M1) is exhausted and the support surface (AP) of the same unit (M1) is in the maximum lift position (at a height that exceeds the maximum height of the complete stack of the other unit M2), while the unit (M2) is approaching the operating position (position for picking up the dies from the respective stack by the means of transport and picking up the dies). The process is completed when the unit (M1) reaches the waiting position, where the latter will receive a new stack of dies, and the unit (M2) reaches the operating position. This process is cyclical. Therefore, in the position where the dies are picked up by the dies picking and transport means, there are always available dies, without interrupting the dies feeding process. This helps to increase production since a storage unit (M1, M2) from which the dies can be taken is always ready.

With reference to the example shown in the drawings, in each storage unit (M1, M2) said surface (AP) is formed by a lift equipped with forks (FM) which can be moved vertically along a vertical guide (MG) by means of a corresponding gear motor (MM) acting on the forks by means of a chain (XZ). The forks (FM) of each storage unit (M1, M2) extend from the respective vertical guide (MG) towards the inside of the machine body (CM) for a predetermined length. The vertical guides (MG) are in turn linked to a horizontal guide system so that one of them can be moved horizontally along the left side and the other along the right side of the machine body. For example, each vertical guide (MG) has a lower side slidingly mounted along a respective lower horizontal guide (9G) formed on a lower part of the left, respectively right, side of the machine body. Furthermore, each vertical guide (MG) has an upper side slidingly mounted along an upper horizontal guide (SM) formed on an upper part of the left, respectively right, side of the machine body. In the drawings, the reference "PM" indicates pads arranged in the lower part of a rear side of the vertical guides (MG) (side facing the outside of the machine body) to facilitate sliding along the lower horizontal guides 9G). The upper side of the vertical guides (MG) is connected to the respective upper horizontal guide (SM) by means of upper pads (PU). Each gearmotor (MH) is connected to the respective forklift by means of a belt (CE) constrained to two upper appendages (AS) of the vertical guide (MG) protruding vertically above the upper pads (PU).

Figure 10:
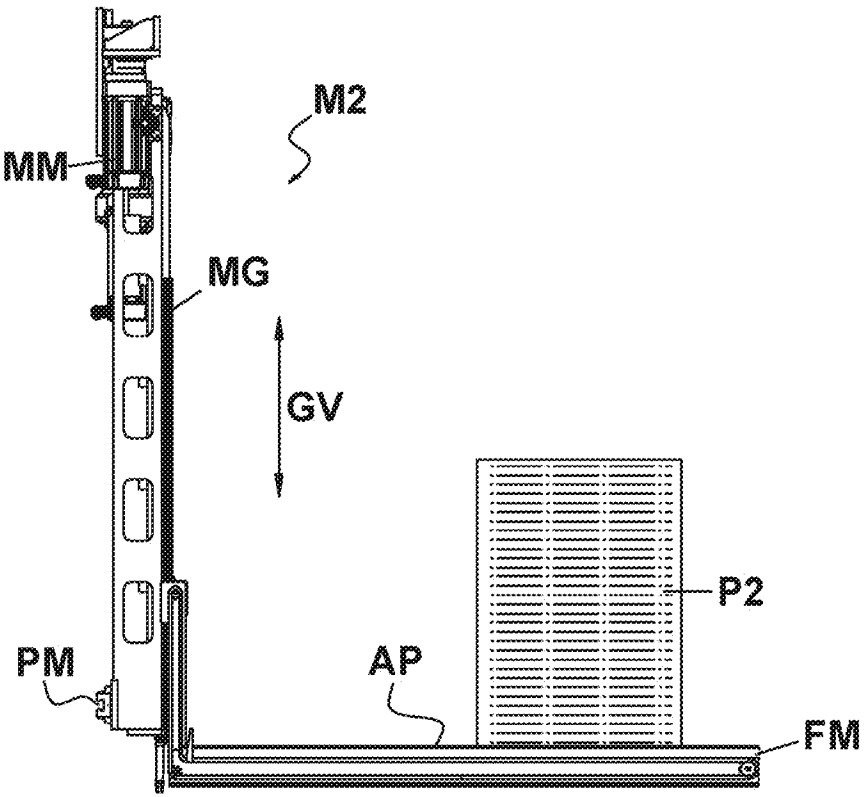
FIGS. 9-11 show, in order, a front view, a side view and a rear view of a storage unit.
Figure 9:
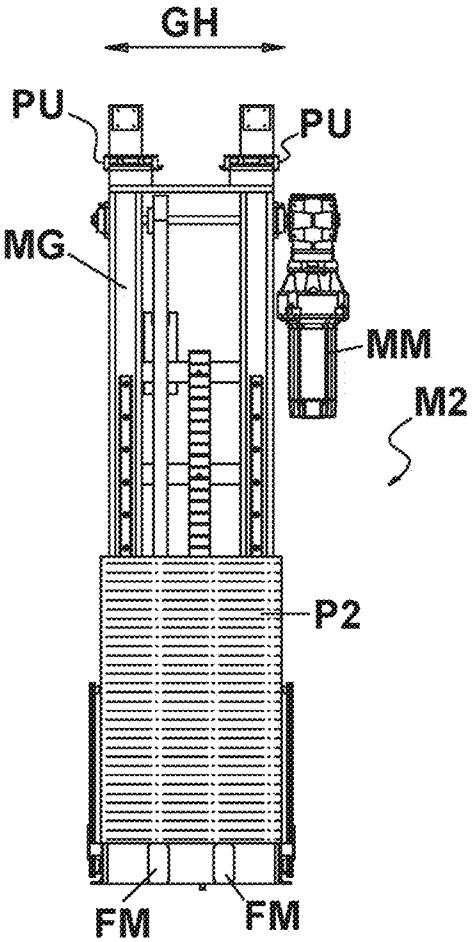
Figure 12:
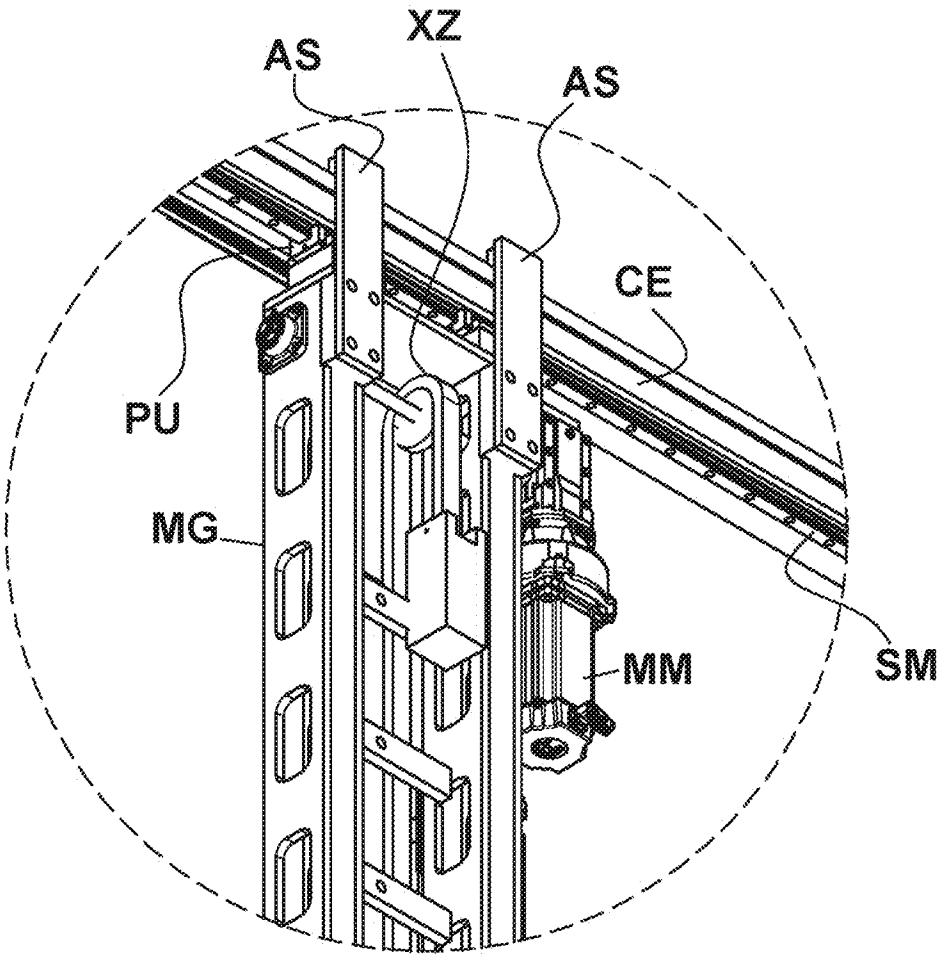
FIG. 12 is a detail of a storage unit.
Figure 11:
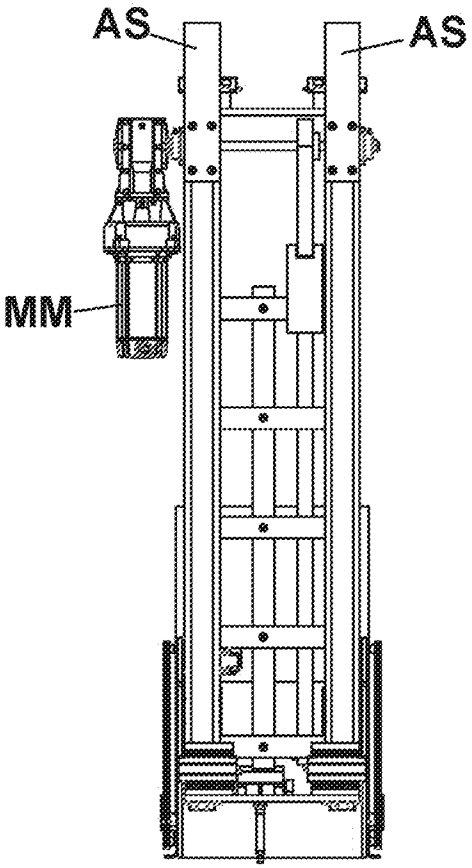

Preferably, the forks (FM) are sized in such a way as to be able to pass through the rollers of a roller conveyor (RU) arranged in a lower region of the rear side of the machine body. The roller conveyor (RU) makes it easier for the operators to place the stacks (P) of dies in the machine body. In FIG. 9 and FIG. 10 the double arrows "GH" and "GV" respectively represent the horizontal movement of a storage unit and the vertical movement of the respective support surface (AP).

For example, according to an operating configuration per se known, the means for picking up and transporting the dies consist of two picking and transport units (G1, G2), mounted sliding along the left side (ST) or along the right side (DT) of the machine body (CM). In practice, a unit (G1) for picking up and transporting the dies is capable of picking up the individual dies (F) from the magazine (M) and transporting them to the unfolding station (S), while the other unit (G2) allows the transport the open boxes (C), obtained by unfolding the dies, to the product insertion station (N).

For example, in FIG. 13 the picking and transport unit (G1) is picking up a die from the magazine (M) while the picking and transport unit (G2) is picking up a box (C) in the unfolding station (S).

For example, each unit (G1, G2) for picking up and transporting the dies comprises a plurality of pneumatic suction cups (MV) mounted on respective arms (BV) protruding from a first carriage (PC) which is slidably mounted along a rear surface (TS) of a second carriage (SC) by means of a respective vertical appendage (GV) which is moved, along the back surface of the second carriage (SC), by a gear motor (XM). The latter, for example, can be fixed to the second carriage (SC) and connected to the first carriage (PC) via a belt drive (B1). Therefore, the first carriage (PC), and with it the pneumatic suction cups (MV), can be lowered and raised along the vertical direction while remaining constrained to the second carriage (SC). In this example, the second carriage (SC) is constrained to a horizontal guide (HG) formed on a cross member (TT) at the top left side of the machine body. The second carriage (SC) is connected to a respective gearmotor (NM; NP). For example, the second carriage (SC) can be connected to the respective gear motor (NM; NP) via a corresponding belt drive (BM; BP). In the enlarged detail of FIG. 13 the gearmotors (NM; NP) and the belts (BM; BP) are shown in plan view for greater clarity. The horizontal guide (HG) extends between the operating position of the storage unit (M1, M2) in use and the insertion station (N). Therefore, the suction cups (MV) can be moved both vertically, as previously mentioned, and horizontally. In the drawings, the vertical movement of the suction cups (MV) is indicated by the double arrow "10" while the horizontal movement is indicated by the double arrow "20". In the drawings, the reference "ZK" indicates pads arranged on a rear side (side facing the outside of the machine body) of the second carriage (SC) to facilitate its sliding along the respective guide (HG).

The operation of such a system for picking up and transporting the dies is known to those skilled in the art.

FIG. 13 shows protruding teeth (FJ) which, in the product insertion station (N) and in the box closing station (G) (C), contain the same boxes laterally while these move along the direction (FN). For example, the teeth (FJ) can be teeth protruding from belts driven by an electric motor (MJ) and supported by respective bases (S3, S4). The same figures also schematically show nozzles (NJ) suitable for spraying glue on the flaps of the boxes (C). As previously stated, the product insertion and box closing stations (C) can be configured in a manner known per se.

However, it is understood that in accordance with possible alternative embodiments of the present invention, the station for closing the filled boxes could be set up in a different position, ie not immediately adjacent to the station for inserting the products. In this case, an exit can be provided for the filled but unclosed boxes and a separate operating station in which, for example, the filled boxes are closed with adhesive tape or even with glue.

In the block diagram of FIG. 18 the control unit (GC) controls the actuators (MM, MH) of the storage units (M1, M2). For example, photocell optical means (OP) provided in the dies pick-up position and connected to the control unit (GC) allow for automatic management of the position exchange of the storage units (M1. M2).

In practice, a cartoning machine according to the present invention comprises

- a magazine configured to store stacks of cardboard dies (F);
  - an unfolding station (S), in which the cardboard dies (F) are put into shape, assuming the shape of an open box (C);
- a product (RC) feeding station (A), into which products (RC) destined to be packaged in boxes (C) obtained from the cardboard dies are fed (F);
- a product insertion station (N), in which the products (RC) are inserted into the open boxes (C);
  - an exit station (U) for the boxes with the products (RC) inside them;
- means for picking up and transporting the cardboard dies (F) configured and controlled for moving the cardboard dies (F) along a path (FM, FS) between the magazine, the unfolding station (S) and the product insertion station (N); and
- the magazine comprises two mobile storage units (M1, M2) for stacked cardboard dies, each mobile storage unit (M1, M2) being configured to store a respective stack (P1, P2) of cardboard dies (F);
- each mobile storage unit (M1, M2) is enslaved to respective moving means (MM; MH) controlled by a control unit (GC) which is programmed to cyclically arrange each storage unit (M1, M2) in a waiting position while the other storage unit (M2, M1) is in an operative position in which the means for picking up and transporting the cardboard dies are arranged and acting;
- said storage units (M1, M2) are arranged one on a right side (DT) and one on a left side (ST) of the machine with respect to said path (FM, FS).

A machine according to the present invention can also have one or more of the following features possibly combined between them:

- each storage unit (M1, M2) comprises a support surface (AP) for the respective stack (P1, P2) which is raised each time a card board die (F) is picked up.
- in each storage unit (M1, M2) said surface (AP) is formed by an elevator equipped with forks (FM).
- the forks (FM) of each storage unit (M1, M2) extend towards the inside of the machine for a predetermined length.
- the forks (FM) are mounted on vertical guides (MG) that, in turn, are bound to a horizontal guide system.
- each vertical guide (MG) has a lower side slidingly mounted along a respective lower horizontal guide (9G) and has an upper side slidingly mounted along an upper horizontal guide (SM).

Although in the diagram of FIG. 1 the aforementioned path (FM, FS) is a completely straight path, it is understood that, depending on the specific layout of the machine, this path could nevertheless consist of a line formed by consecutive segments each of which forms a predetermined angle with the segments adjacent to it.

In practice, the details of execution can in any case vary in an equivalent way as regards the individual elements described and illustrated, without thereby departing from the protection offered by the present patent in accordance with the following claims.

The invention claimed is:

1. A cartoning machine comprising a magazine configured to store stacks of cardboard dies;

a case erection station, in which the cardboard dies are put into shape, assuming the shape of an open box;

a product feeding station, into which products destined to be packaged in boxes obtained from cardboard dies are fed;

a product insertion station, in which the products are inserted into the open boxes;

an exit station for the boxes with the products inside them;

means for picking up and transporting the cardboard dies configured and controlled for moving the cardboard dies along a path between the magazine, the case erection station and the product insertion station, the means for picking up and transporting the cardboard dies comprising a plurality of suction cups that are mounted on a carriage arrangement controlled by motor means controlling the movement of the carriage arrangement along horizontal and vertical guides;

wherein the magazine comprises two mobile storage units for stacked cardboard dies, each mobile storage unit being configured to store a respective stack of cardboard dies;

the mobile storage units are arranged one on a right side and one on a left side of the cartoning machine with respect to said path;

each mobile storage unit is enslaved to respective mobile storage unit moving means controlled by a control unit which is programmed to cyclically arrange each storage unit in a waiting position while the other storage unit is in an operative position in which the means for picking up and transporting the cardboard dies are arranged and acting, the mobile storage unit moving means comprising an actuator that moves each mobile storage unit along the respective right side or left side of the cartoning machine.

2. The cartoning machine according to claim 1 characterized in that each storage unit comprises a support surface of the respective stack which is raised each time a cardboard die is picked up.

3. The cartoning machine according to claim 2 characterized in that in each storage unit said surface is formed by an elevator equipped with forks.

4. The cartoning machine according to claim 3 characterized in that the forks of each storage unit extend towards the inside of the machine for a predetermined length.

5. The cartoning machine according to claim 3 characterized in that the forks are mounted on vertical guides that, in turn, are bound to a horizontal guide system.

6. The cartoning machine according to claim 3 characterized in that each vertical guide has a lower side slidingly mounted along a respective lower horizontal guide and has an upper side slidingly mounted along an upper horizontal guide.

* * * * *